US011801583B2

(12) United States Patent
Lang et al.

(10) Patent No.: US 11,801,583 B2
(45) Date of Patent: Oct. 31, 2023

(54) WORKPIECE CLAMPING DEVICE

(71) Applicant: Lang Technik GmbH, Holzmaden (DE)

(72) Inventors: Guenter Lang, Wernau (DE); Philipp Lang, Holzmaden (DE)

(73) Assignee: LANG TECHNIK GMBH, Holzmaden (DE)

( * ) Notice: Subject to any disclaimer, the term of this patent is extended or adjusted under 35 U.S.C. 154(b) by 119 days.

(21) Appl. No.: 17/150,179

(22) Filed: Jan. 15, 2021

(65) Prior Publication Data

US 2021/0220967 A1 Jul. 22, 2021

(30) Foreign Application Priority Data

Jan. 17, 2020 (DE) ..... 10 2020 101 064.8

(51) Int. Cl.
*B25B 1/10* (2006.01)
*B25B 1/12* (2006.01)

(52) U.S. Cl.
CPC ..... *B25B 1/103* (2013.01); *B25B 1/12* (2013.01)

(58) Field of Classification Search
CPC .. B25B 1/103; B25B 1/12; B25B 1/02; B25B 1/10; B25B 5/003; B25B 5/006; B25B 5/10; B23Q 1/62
USPC ..... 269/101
See application file for complete search history.

(56) References Cited

U.S. PATENT DOCUMENTS 8,020,877 B2 9/2011 Lang
9,962,812 B2 5/2018 Schlussel
2009/0315238 A1 12/2009 Schroeder et al.
2012/0169000 A1 7/2012 Lin et al.
2016/0023329 A1* 1/2016 Schlüssel ..... B25B 1/103 269/242

FOREIGN PATENT DOCUMENTS

DE 102013104467 A1 6/2014
DE 20214005498 U1 9/2014
DE 202014005498 U1 9/2014
(Continued)

OTHER PUBLICATIONS

EP Search Report for Application No. 21 15 1282; dated Jun. 10, 2021.
(Continued)

*Primary Examiner* — Tyrone V Hall, Jr.
*Assistant Examiner* — Abbie E Quann
(74) *Attorney, Agent, or Firm* — CANTOR COLBURN LLP

(57) ABSTRACT

A workpiece clamping device having a first base body on which a first clamping body is slidably supported in a clamping direction, as well as a second base body on which a second clamping body is slidably supported in the clamping direction. The two clamping bodies are in engagement with a threaded spindle. A contact surface is provided on each base body on the side that faces the other base body respectively. The contact surfaces are arranged with base body distance in the clamping direction. A centering body of the threaded spindle has centering surfaces that abut at one assigned contact surface respectively in order to position the threaded spindle in clamping direction without clearance as far as possible.

20 Claims, 8 Drawing Sheets

(56) References Cited

FOREIGN PATENT DOCUMENTS

| | | | |
|---|---|---|---|
| DE | 102014110352 | B3 | 10/2015 |
| DE | 102017122112 | A1 | 3/2019 |
| EP | 1946890 | A1 | 7/2008 |

OTHER PUBLICATIONS

German Office Action for Application No. 10 2020 101 064.8; dated Nov. 10, 2020.

* cited by examiner

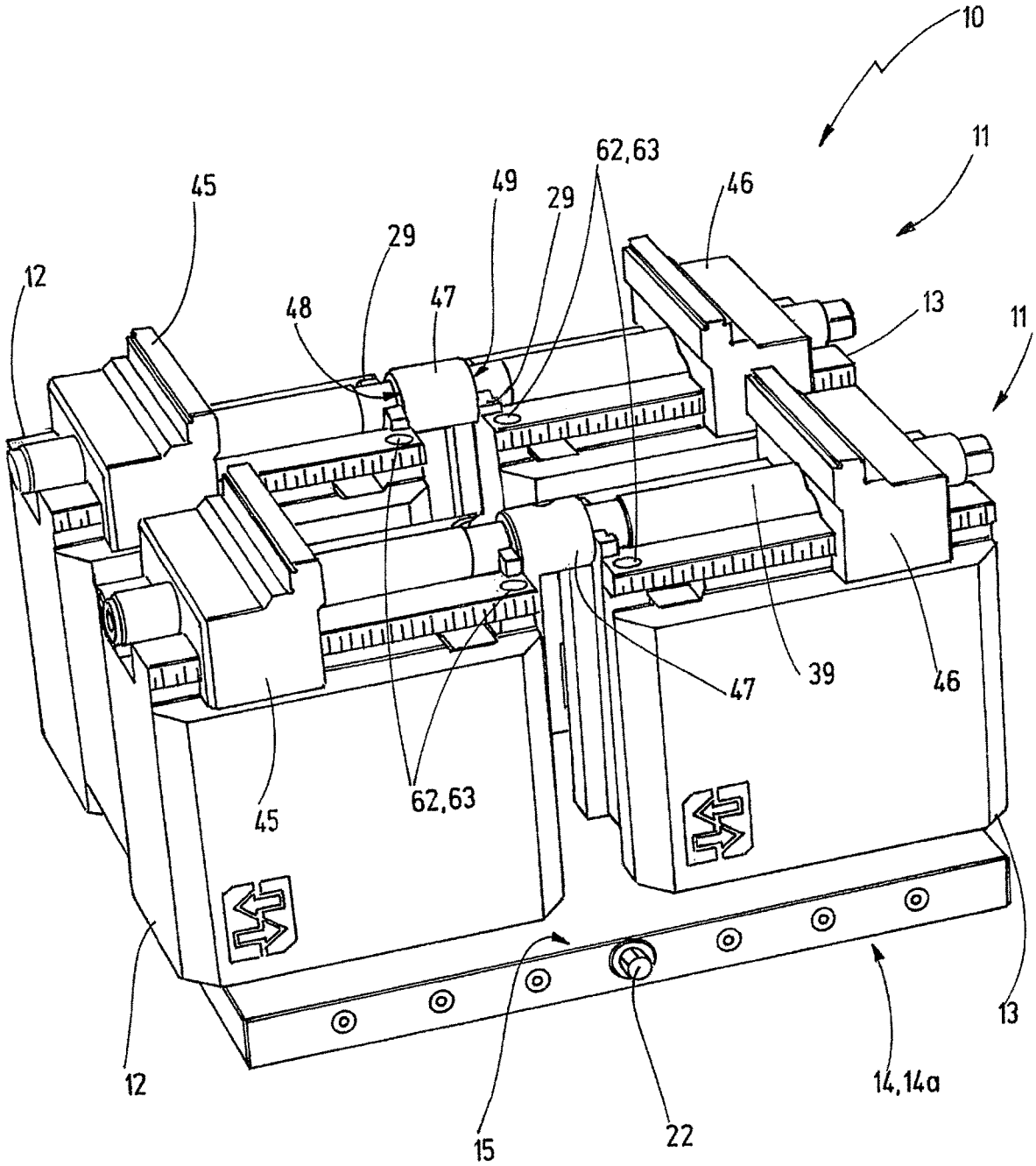
Fig.2
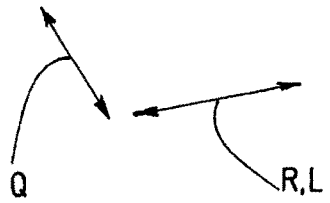

WORKPIECE CLAMPING DEVICE

CROSS REFERENCE TO RELATED APPLICATIONS

This application claims priority under 35 U.S.C. § 119 to the following German Patent Application No. 10 2020 101 064.8, filed on Jan. 17, 2020, the entire contents of which are incorporated herein by reference thereto.

TECHNICAL FIELD

The invention refers to a workpiece clamping device that is configured for clamping a workpiece. For this the workpiece clamping device has two clamping bodies that can be moved in a clamping direction toward each other or away from each other by driving a threaded spindle in order to clamp or release a workpiece.

BACKGROUND

A workpiece clamping device is, for example known from DE 10 2017 122 112 A1. A support block is centrally supported between the slidably supported clamping bodies. A threaded spindle for moving the clamping bodies is configured in a multiple part manner. Each part of the threaded spindle is supported by means of a threaded sleeve in the support block. The threaded sleeves abut with a flange on the outer surface of the support block. The threaded sleeves are connected with each other by means of a strengthening sleeve. Alternatively, also a continuous thread support can be used instead of the strengthening sleeve and the threaded sleeves.

BRIEF SUMMARY

Starting from the prior art it is an object of the present invention to center the threaded spindle with regard to a center plane in a simple manner and to ensure a simple and easy maintenance of the clamping device.

This object is solved by means of a clamping device with the features of claim 1.

The clamping device has a first base body and a second base body. Both base bodies have a contact surface on the face that faces the respective other base body. In a clamping direction the contact surfaces are arranged opposite each other in a base body distance. The base body distance is defined by the distance between the contact surface of the first base body and the contact surface of the second base body.

The two base bodies are attached by means of a base surface on a support, particularly releasably attached. An attachment device can serve for attachment. Each base body can be attached on the support by means of a separate attachment device. The support can consist of one or more support plates. The releasable attachment of the base bodies on the support can be realized by means of a force-fit and/or friction-fit connection.

A first clamping body is shiftably supported in clamping direction on the first base body. A second clamping body is shiftably supported in clamping direction on the second base body. Each clamping body can comprise a clamping surface with which they act on a workpiece for clamping. In addition or as an alternative, a clamping jaw on which a clamping surface is provided for clamping of a workpiece, can be attached to each clamping body.

In addition, the workpiece clamping device comprises a threaded spindle extending in clamping direction. The threaded spindle has a first thread section that is in engagement with a counter thread of the first clamping body. Also, the threaded spindle has a second thread section that is in engagement with a counter thread of the second clamping body. The first thread section and the second thread section have different rotation directions or rotation senses. The amount of the pitch is equal in the first thread section and the second thread section. During a rotation of the threaded spindle around its spindle longitudinal axis the two clamping bodies move by the same distance relative to an immovable coordinate system toward each other or away from each other.

Between the two thread sections the threaded spindle comprises a centering body. The centering body has one centering surface on each of the two sides facing in clamping direction respectively. The two centering surfaces define a centering plane that is centrally arranged between the two centering surfaces and is orientated orthogonal to the clamping direction. The centering body is preferably rotationally symmetrical. For example, the centering body can have a cylindrical outer contour and can be particularly configured as centering sleeve.

The centering body is with one centering surface in contact with the contact surface of the first base body and with its other opposite centering surface in contact with the contact surface of the second base body. In doing so, it is guaranteed that the centering plane is exactly located between the two contact surfaces and thus between the two base bodies. A workpiece can thus be clamped centrically from opposite sides relative to the center plane by means of the clamping bodies.

This configuration of the workpiece clamping device comprises a very simple composition. For centering of the threaded spindle relative to the base bodies it is not necessary to provide a support between the base bodies that supports the threaded spindle on the support for the workpiece clamping device. The threaded spindle is supported exclusively or mainly via the clamping bodies and the base bodies on the support.

The centering of the threaded spindle is carried out by means of a plain bearing contact between the two surface pairs consisting of one contact surface and one centering surface in each case.

It is advantageous, if each base body comprises a terminal part comprising the contact surface. Preferably the terminal parts are separate from the base bodies and particularly releasably attached to the assigned base body respectively. For this the base body can have a mounting surface that is orientated substantially orthogonal to the clamping direction. If the terminal parts are separate elements, for example plate-shaped elements, a material can be used for manufacturing of the terminal parts that does not have to coincide with the material of the base body. In addition or as an alternative, the terminal part can be provided with a coating. Further the terminal part or at least one contact surface of the terminal part can be precisely manufactured by grinding or another high precision method. The processing of the terminal part for creation of the contact surface is simplified, if the terminal part can be handled independent from the base body.

In a preferred embodiment the terminal part has multiple contact surfaces. For example, each terminal part has a first contact surface on a first side and a second contact surface on a second side opposite the first side. Thereby it is advantageous, if each terminal part has a first attachment surface on the first side and a second attachment surface on the second side. The attachment surfaces are configured to releasably attach the terminal part on the mounting surface of the assigned base body. Thus, each terminal part can be arranged on the assigned base body in two different positions or orientations. Thereby either the first contact surface or the second contact surface can get in abutment with the adjacent centering surface of the centering body.

In a configuration of the terminal part with multiple contact surfaces, the contact surfaces can have different distances relative to the attachment surfaces in clamping direction. Particularly in a preferred embodiment, a first distance is present between the first contact surface and the second attachment surface in clamping direction and a second distance is present between the second contact surface and the first attachment surface in clamping direction. The first distance and the second distance have different amounts. Due to this configuration, the first contact surface facing the centering body has a different distance from the mounting surface of the base body, if the second attachment surface of the terminal part is in contact with the mounting surface, compared with an orientation of the terminal part, where the second contact surface is facing the centering body and the first attachment surface is in contact with the mounting surface. Due to this configuration of the terminal parts, tolerances can be compensated during attachment of the base body on the support, such that the centering body can be arranged in a blocking-free manner between either the two first contact surfaces or the two second contact surfaces of the terminal parts. The difference between the first distance and the second distance can be preferably less than 1 mm.

It is advantageous, if the first contact surface and the second attachment surface are arranged on the first side of the terminal part in a common plane. On the second side the terminal part can comprise a first step that separates the second attachment surface from the second contact surface, particularly in that the second attachment surface and the second contact surface extend in parallel planes that are offset from one another in clamping direction.

In another preferred embodiment each terminal part comprises a recess that is particularly open on a side facing the threaded spindle. The threaded spindle can extend through the recess of the terminal part. The recess can extend in a circular arc-shaped manner with view in clamping direction, at least in one section, the radius of which is larger than the radius of the threaded spindle at the location where it extends through the recess.

A surface limiting the recess of the terminal part can serve as limiting surface. The limiting surface is located preferably with distance to the threaded spindle, if the threaded spindle is in engagement with the counter threads of the clamping bodies. When exchanging clamping bodies the limiting surfaces of the terminal parts can be used as storage surfaces for the threaded spindle.

It is advantageous, if the threaded spindle comprises a first spindle part having the first thread section and a second spindle part separate therefrom having the second thread section. Preferably the two spindle parts are directly or indirectly connected with each other by means of a form-fit connection and/or a force-fit connection and/or a material bond connection and/or an adhesive bond connection. In a preferred embodiment both spindle parts are connected with each other by means of the centering body. In this configuration the centering body can be preferably sleeve-shaped and can enclose the ends of the spindle parts facing each other. It is advantageous, if the connection between the ends of the spindle parts and the centering body is established by means of a thread engagement and an additional adhesive connection in each case. This ensures that the connection is not released during the rotational drive of the threaded spindle.

By means of the embodiments of the workpiece clamping device described above, arrangements having at least two workpiece clamping devices can be built. For example, an arrangement can comprise at least two workpiece clamping devices, the threaded spindles of which extend parallel in a longitudinal direction and with distance to each other. Thereby the two centering bodies are particularly arranged such that they define a common center plane and are arranged in longitudinal direction symmetrically or centrally with regard to this common center plane. In doing so, a workpiece can be centrally clamped with reference to the center plane by means of four or more clamping bodies.

In another arrangement the threaded spindle of one workpiece clamping device can extend in a longitudinal direction and the threaded spindle of the further workpiece clamping device can extend in a transverse direction orthogonal to the longitudinal direction. The two threaded spindles cross each other at a junction location. At the junction location the threaded spindles can be offset to one another in a height direction that is orientated orthogonal to the longitudinal direction and orthogonal to the transverse direction. In this arrangement the center plane of the centering body of one threaded spindle extends preferably along the spindle longitudinal axis of the respective other threaded spindle.

If an arrangement comprises more than two workpiece clamping devices, the clamping bodies of different workpiece clamping devices can be configured to distinguish from each other. For example, a workpiece can be predominantly held and clamped by means of the first clamping body and the second clamping body of one workpiece clamping device, whereas the clamping bodies of the one or more other workpiece clamping devices are used for additional supporting the workpiece.

BRIEF DESCRIPTION OF THE FIGURES

Preferred embodiments of the invention can be derived from the dependent claims, the specification and the drawings. In the following preferred embodiments of the invention are explained in detail with reference to the attached drawings. The drawings show:

FIGS. 1-3 a perspective illustration of different arrangements comprising two workpiece clamping devices according to the invention respectively, FIG. 4 a partly sectional illustration through a base body along an attachment surface of a terminal part arranged on the base body in a schematic illustration, FIGS. 5 and 6 a schematic principle illustration of arranging an embodiment of a terminal part in different orientations respectively, FIG. 7 a schematic partly sectional illustration of a part of an embodiment of a workpiece clamping device in the area of the center plane, FIG. 8 a perspective illustration of additional embodiments of a workpiece clamping device having base bodies that comprise multiple-coupled base body parts, FIG. 9 a longitudinal section through an embodiment of the workpiece clamping device of FIG. 8 and FIG. 10 an enlarged section X of FIG. 9 at a connection location between two base body parts.

DETAILED DESCRIPTION

Figure 1:
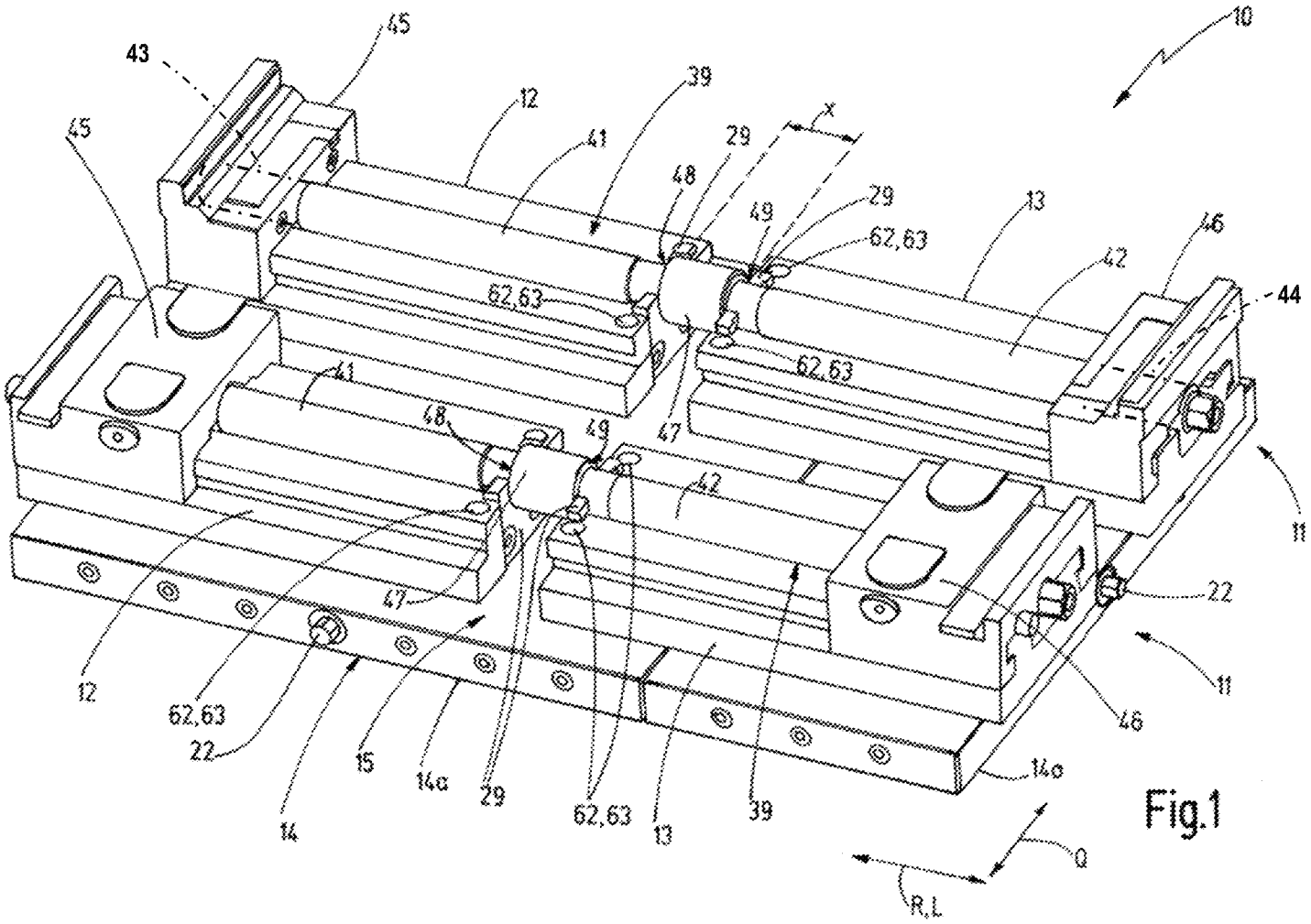
Figure 3:
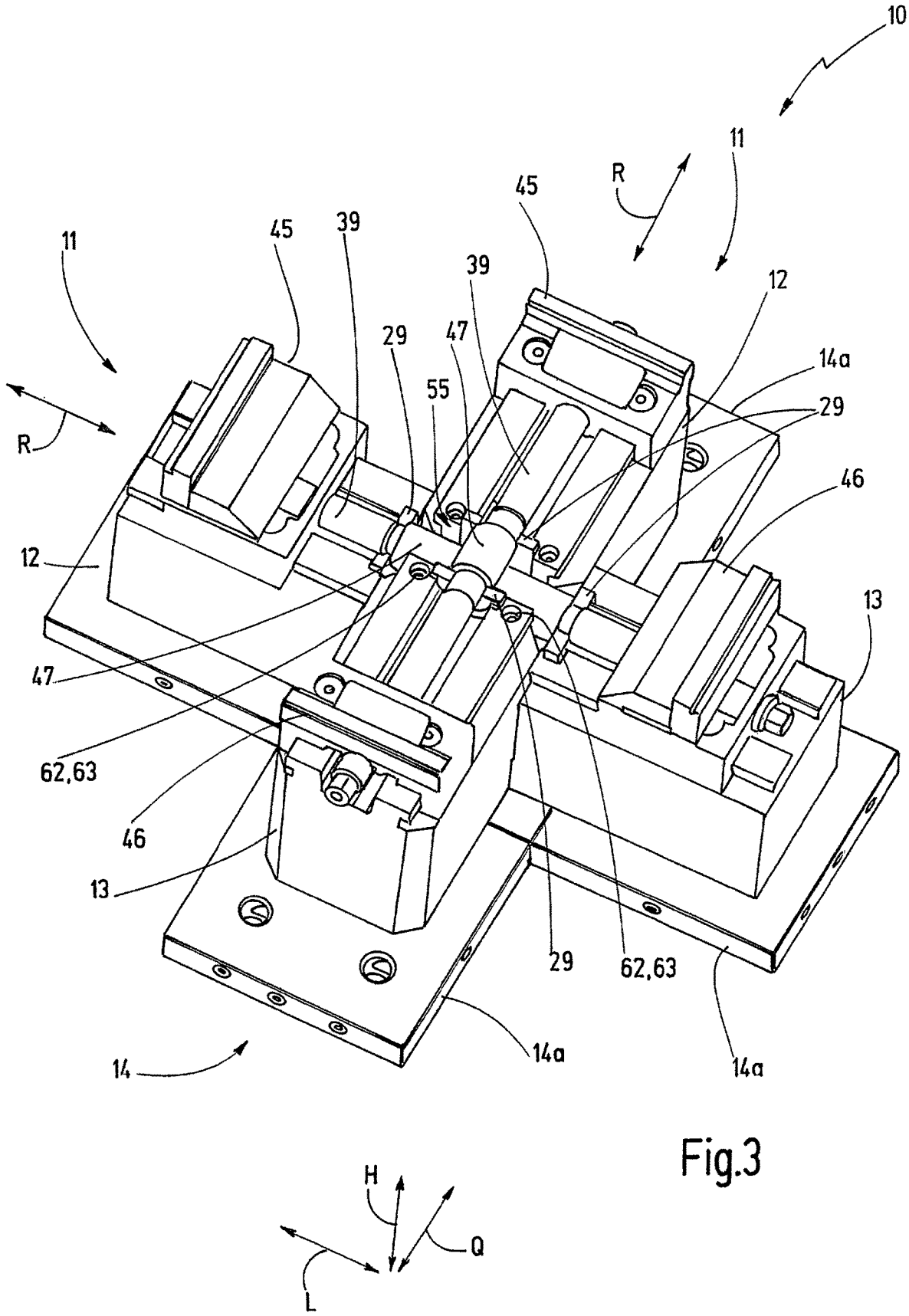

FIGS. 1-3 show different arrangements 10 having two workpiece clamping devices 11 respectively. In modification to the illustrated embodiments, an arrangement 10 can comprise one, two or also more than two workpiece clamping devices 11. A single workpiece clamping device 11 or an arrangement 10 with multiple workpiece clamping devices 11 is configured to clamp a workpiece centrally relative to a center plane M. The workpiece clamping devices 11 are configured substantially identically, such that an individual workpiece clamping device 11 is first illustrated in detail.

Each workpiece clamping device 11 has a first base body 12 and a second base body 13. The two base bodies are configured to arrange the workpiece clamping device 11 on a support 14. The support 14 comprises, at least in sections, a planar support surface 15. Each base body 12, 13 has a bottom side that is planar, at least in sections, and that is configured to be arranged on the support surface 15 of the support 14.

Figure 7:
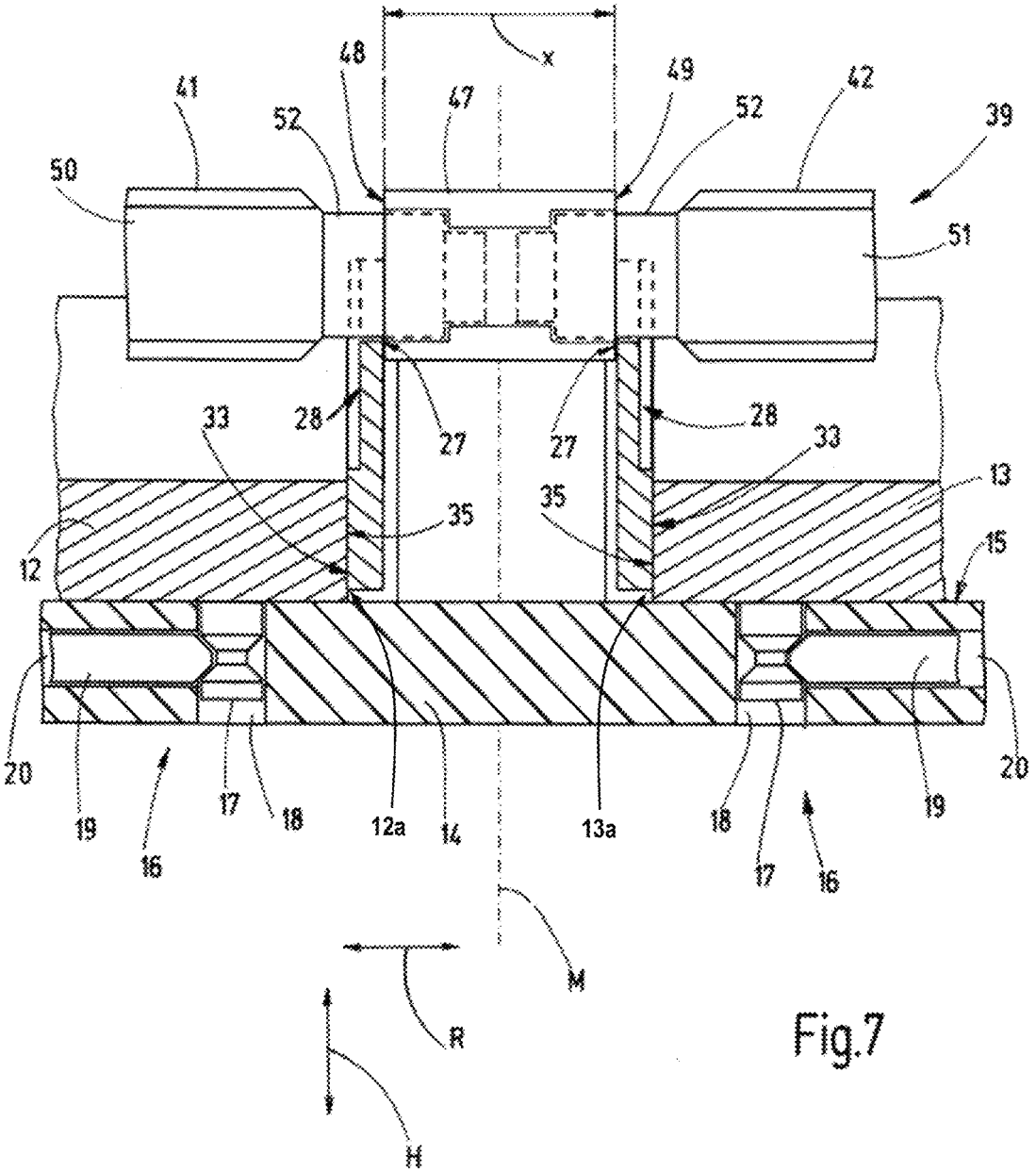

The base bodies 12, 13 can be connected with the support 14 in a form-fit and/or force-fit manner by means of an attachment device 16 (FIG. 7). For this each base body 12, 13, comprises multiple and according to the example four attachment pins 17 that project from its bottom side. Holes 18 are provided in the support 14 in which the attachment pin 17 may project. The holes 18 and the attachment pins 17 are preferably arranged in a predefined grid, such that the support 14 comprises a hole grid on which the base body 12, 13 may be plugged in the desired position by means of the attachment pins 17.

Multiple slides 19 are part of the attachment device 16 that are shiftably arranged in channels 20 of support 14. Each channel 20 opens in a hole 18 such that a free end of the slide 19 can apply a force on an attachment pin 17 inserted in the hole 18.

In the embodiment each attachment pin 17 comprises a circumferential attachment groove 21 that narrows inwardly via two taper or wedge surfaces. The slide has an end section that narrows toward its free end via taper or wedge surfaces such that it can engage into the attachment groove 21. For clamping a base body 12, 13 on the support 14 and against the support surface 14, a tensile force along the extension direction of an attachment pin 17 is applied that is also pressed against a circumferential wall of the hole 18 by means of multiple slides 19 acting on multiple attachment pins 17. In doing so, the base body 12, 13 is pulled with its base surface against the support surface 15 and concurrently secured in a plane in that the support surface 15 extends.

As already mentioned, each base body 12, 13 can comprise four attachment pins 17 such that the base body is releasably attached on the support 14 by means of four slides 19.

The support 14 can be formed by multiple separate support plates 14*a* (FIGS. 1 and 3). In each support plate 14*a* at least one operation element 22 accessible from outside is provided by means of which a sliding movement of multiple and according to the example, four slides 19 can be carried out substantially synchronously in the respective support plate 14*a*. Depending on the arrangement of the respective base body 12, 13 on the support 14, the base body 12, 13 can be attached to the support 14 by operating one single operation element 22. It can also be necessary to operate two or more operation elements 22 in order to firmly clamp the base body 12 or 13 on the support 14.

The first base body 12 and the second base body 13 of a common workpiece clamping device 11 are arranged in a defined base body distance x relative to one another. The first base body 12 comprises a contact surface on the side facing the second base body 13, wherein it can be a first contact surface 27 or a second contact surface 28. The second base body 13 comprises a contact surface on the side facing the first base body 12 that in turn may be a first contact surface 27 or a second contact surface 28. The first contact surfaces 27 or second contact surfaces facing each other extend parallel to the center plane M (FIG. 7) that is orientated orthogonal to the clamping direction R. The base body distance x is defined between the two first contact surfaces 27 or second contact surfaces 28 facing each other. The center plane M is arranged centrally between the contact surfaces facing each other.

A separate terminal part 29 is arranged on the first base body 12 as well as the second base body 13 respectively. Each terminal part 29 has a first side 30 and a second side 31 opposite the first side 30. On the first side 30 the terminal part 29 comprises the first contact surface 27. In addition, a first attachment surface 32 is provided on the first side 30 that is arranged adjacent to the first contact surface 27. The terminal part 29 comprises a second contact surface 28 on the second side 31. In addition, a second attachment surface 33 is provided on the second side 31 of the terminal part 29 that is arranged adjacent to the second contact surface 28.

Figure 4:
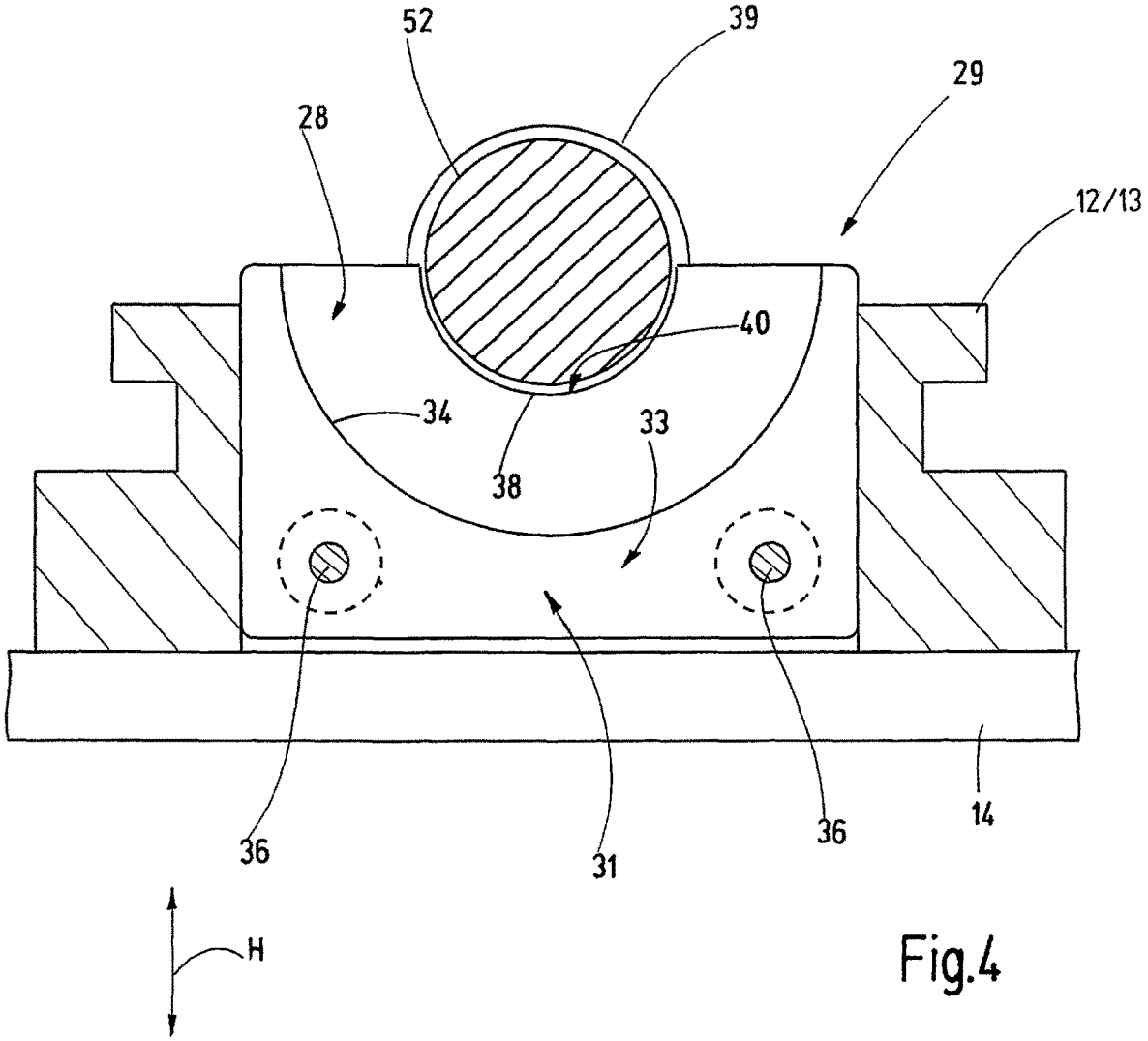
Figure 5:
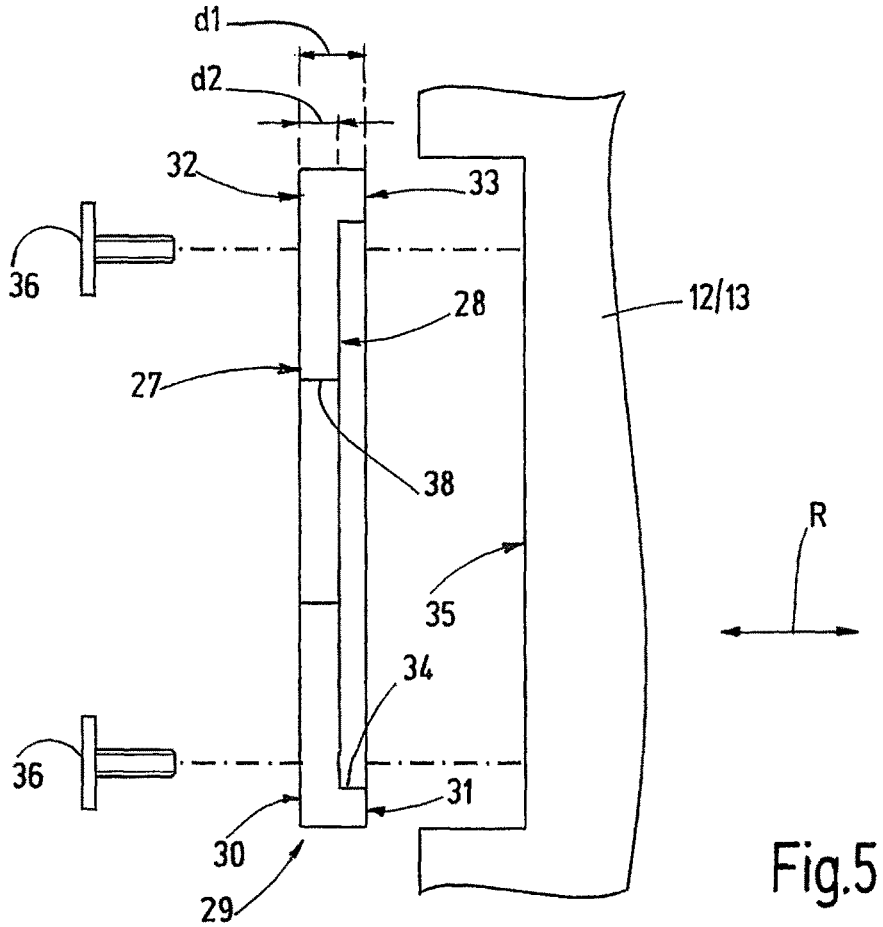
Figure 6:
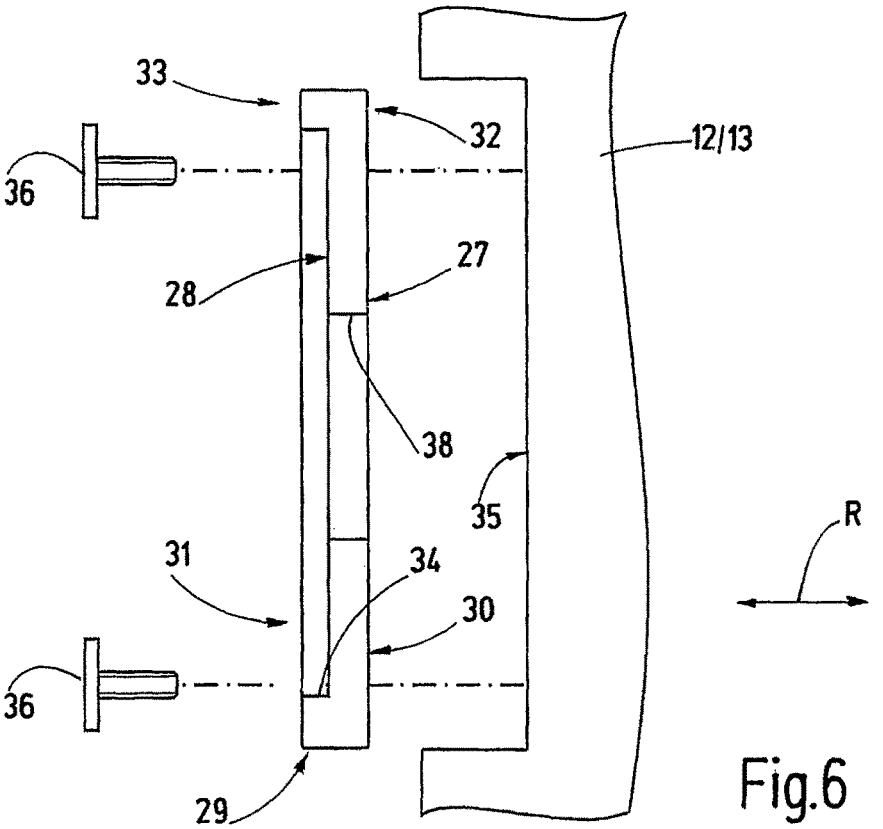

In the embodiment illustrated in FIGS. 4-6 the second contact surface 28 is offset with regard to the second attachment surface 33 in clamping direction R, for example separated by means of a step 34. The first contact surface 27 and the first attachment surface 32 extend in the same plane on the first side 30 according to the example.

The first contact surface 27, the second contact surface 28, the first attachment surface 32 and the second attachment surface 33 are preferably planar surfaces and extend parallel to each other and in the mounted condition parallel to the center plane M. In clamping direction R the first contact surface 27 has a first distance d1 from the second attachment surface 33. In clamping direction R the second contact surface 28 has a second distance d2 from the first attachment surface 32. The distances are schematically illustrated in FIG. 5.

The first attachment surface 32 and the second attachment surface 33 are respectively configured to be in contact with a mounting surface 35 of the first base body 12 or the second base body 13 in order to attach the terminal part 29 releasably and according to the example by means of a screw connection to the first base body 12 or the second base body 13. For establishment of the screw connection, multiple and according to the example, two screws 36 can be used as exemplarily schematically illustrated in FIGS. 4-6. Thus, the terminal part 29 can be arranged in two different positions or orientations on the mounting surface 35 in that it either abuts the mounting surface 35 either with the first attachment surface 32 or with the second attachment surface 33 (FIGS. 5 and 6). A schematic sectional illustration along the mounting surface 35 with view on the terminal part 29 is illustrated in FIG. 4, wherein the terminal part 29 abuts against the mounting surface 35 with the second attachment surface 33, such that the first side 30 of the terminal part 29 faces away from the mounting surface 35 or the assigned first base body 12 or second base body 13.

On the side facing away from the support 14 the terminal part 29 has a recess 38. The recess 38 is open in a height direction H that is orientated orthogonal to the clamping direction R and orthogonal to the support surface 15. A threaded spindle 39 of the workpiece clamping device 11 can extend through this recess 38 in clamping direction R.

In the embodiment the recess 38 is limited by a circular arc-shaped limiting surface 40. In the completely mounted condition the limiting surface 40 is arranged opposite the threaded spindle 39 forming an interstice. Alternatively, the limiting surface 40 could be at least in sections in contact with the circumferential surface of the threaded spindle 39. During exchange of clamping bodies the limiting surfaces 40 of the terminal parts 29 can be used as storage surfaces for the threaded spindle 39.

The threaded spindle 39 of the workpiece clamping device 11 extends in clamping direction R along the first base body 12 as well as along the second base body 13. The threaded spindle 39 has a first thread section 41 in the area of the first base body 12 and a second thread section 42 in the area of the second base body 13. The first thread section 41 has an opposed sense of rotation relative to the second thread section 42, wherein the amount of the pitch is equal.

A first clamping body 49 is slidably supported in clamping direction R on the first base body 12. A second clamping body 46 is slidably supported in clamping direction R on the second base body 13. A clamping surface or holding surface can be provided on each clamping body 49 for acting on a workpiece to be clamped. As an alternative or in addition, a connection device can be provided on the clamping body 45, 46 for arranging a separate clamping jaw that in turn comprises a clamping surface or holding surface for acting on the workpiece.

The first clamping body 45 is in engagement with the first thread section 41 by means of a counter thread 43. The second clamping body 46 is in engagement with the second thread section 42 by means of a counter thread 44. During a rotation of a threaded spindle around its spindle longitudinal axis the clamping bodies 45, 46 move toward each other or away from each other, depending on the rotation direction of the threaded spindle 39. Thereby the first clamping body 45 moves relative to the first base body 12 and the second clamping body 46 moves relative to the second base body 13 with equal path lengths. Due to this movement of the clamping bodies 45, 46, a workpiece can be clamped or released.

The threaded spindle 39 is exclusively or predominantly supported on the support 14 via the clamping bodies 45, 46 and the base bodies 12, 13. As mentioned, the threaded spindle 39 can be placed on the limiting surfaces 40 of the terminal parts 29 during an exchange or removal of the clamping bodies and is thereby roughly prepositioned for the rearrangement of the clamping bodies 45, 46 on the base bodies 12, 13.

In order to ensure the centralized clamping of the workpiece relative to the center plane M, the threaded spindle 39 must be centered in clamping direction R. For this the threaded spindle 39 comprises a centering body 47 that comprises a first centering surface 48 facing the first base body 12 and a second centering surface 49 facing the second base body 13. The centering surfaces 48, 49 are particularly apparent from FIG. 7. The centering surfaces 48, 49 can extend parallel to one another and particularly orthogonal to the clamping direction R. The first centering surface 48 abuts against the contact surface 27 or 28 of the terminal part 29 arranged on a face 12*a* of the first base body 12. The second centering surface 49 abuts on the contact surface 27 or 28 of the terminal part 29 arranged on a face 13*a* of the second base body 13. Either the two first contact surfaces 27 of the terminal parts 29 are facing the centering body 47 or alternatively, the two second contact surfaces 28 face the centering body 47. Due to the abutment of the first contact surfaces 27 or the second contact surfaces 28 at the respective assigned centering surfaces 48 or 49, the centering body 47 is exactly positioned between the two terminal parts 29 in clamping direction R and thus defines the position of the center plane M. In clamping direction R the center plane M extends through the centering body 47 between the first centering surface 48 and the second centering surface 49.

In order to compensate tolerances during arrangement of the base bodies 12, 13 on the support 14, the terminal parts 29 can be attached in different orientations on the respective assigned base body 12, 13 in the preferred embodiment described here. If the distance between the mounting surfaces 35 of the two base bodies 12, 13 in clamping direction R is varying due to mounting tolerances in different attachment positions on the support 14, the terminal parts 29 can be attached in suitable orientation such that the centering body 47 is in contact with the respective contact surfaces 27 or 28, but is not subject to a too high clamping force in order to not impede the rotation of the threaded spindle 39 and to avoid excessive wear. The compensation is facilitated in that the first contact surfaces 27 have a first distance d1 to the assigned mounting surface 35 respectively, if they are facing the centering body 47 and the second contact surface 28 have a second distance d2 to the assigned mounting surfaces 35 respectively, if they are facing the centering body 47.

In modification to the described embodiment it is not necessary that each terminal part 29 provides different distances d1, d2 and/or can be attached in different orientations on a mounting surface 35. The terminal part 29 can also be plate-shaped having parallel surfaces on both sides and thus provides the same distance between the centering body 47 and the contact surfaces 27, 28 in both orientations. It is also possible to provide terminal parts 29 having different dimensions—at least in clamping direction R—in the manner of a modular system, such that terminal parts 29 with an appropriate dimension can be selected. If a tolerance compensation or clearance compensation in clamping direction R is not required, one single type of a terminal part 29 having one single contact surface and one single attachment surface is sufficient.

As illustrated in FIG. 7, the threaded spindle 39 can have a multi-part configuration. In the embodiment the threaded spindle 39 has a first spindle part 50 with the first thread section 41 and a second spindle part 51 with the second thread section 42. The thread sections 41, 42 end with distance to the respective terminal part 29 in clamping direction R. Each spindle part 50, 51 has an end section 52 adjoining the thread sections 41, 42. The end section 52 can at least comprise an outer thread in one region that is configured to be screwed in a respective inner thread of the centering body 47. In addition, the end section 52 can be configured in a stepped manner with different diameters in order to form a ring surface that serves as stop and can cooperate with a respective counter-stop surface on or in the centering body 47. Due to the stop and the counter-stop, the relative position of each spindle part 50, 51 relative to the centering body 47 can be adjusted very precisely in clamping direction R. In the embodiment each spindle part 50, 51 is connected with the centering body 47 by means of an adhesive bond connection in addition to the screw connection.

Because the centering body 47 comprises hollow cylindrical sections according to the example or is configured in a hollow cylindrical manner, it forms a centering sleeve.

Different arrangements 10 are illustrated in FIGS. 1-3 that can be built by means of a workpiece clamping device 11 as described above. In the embodiments illustrated in FIGS. 1 and 2, two workpiece clamping devices 11 are arranged adjacent to each other, such that their threaded spindles 39 extend parallel to one another in a longitudinal direction L and have a distance to each other in a transverse direction Q that is orientated orthogonal to the longitudinal direction L.

The centering is achieved in that both centering bodies 47 are centrally or symmetrically arranged relative to a common center plane M.

In the arrangement 10, according to FIG. 3, the threaded spindles 39 of the two workpiece clamping devices 11 are arranged in an intersecting or crossing manner forming a junction location 55. The threaded spindles 39 are offset with regard to one another in height direction H. One threaded spindle extends in longitudinal direction L and the other threaded spindle extends orthogonal thereto in transverse direction Q. In the embodiment the positioning is such that the center plane M defined by one centering body 47 extends along the spindle longitudinal axis of the respective other threaded spindle.

Figure 8:
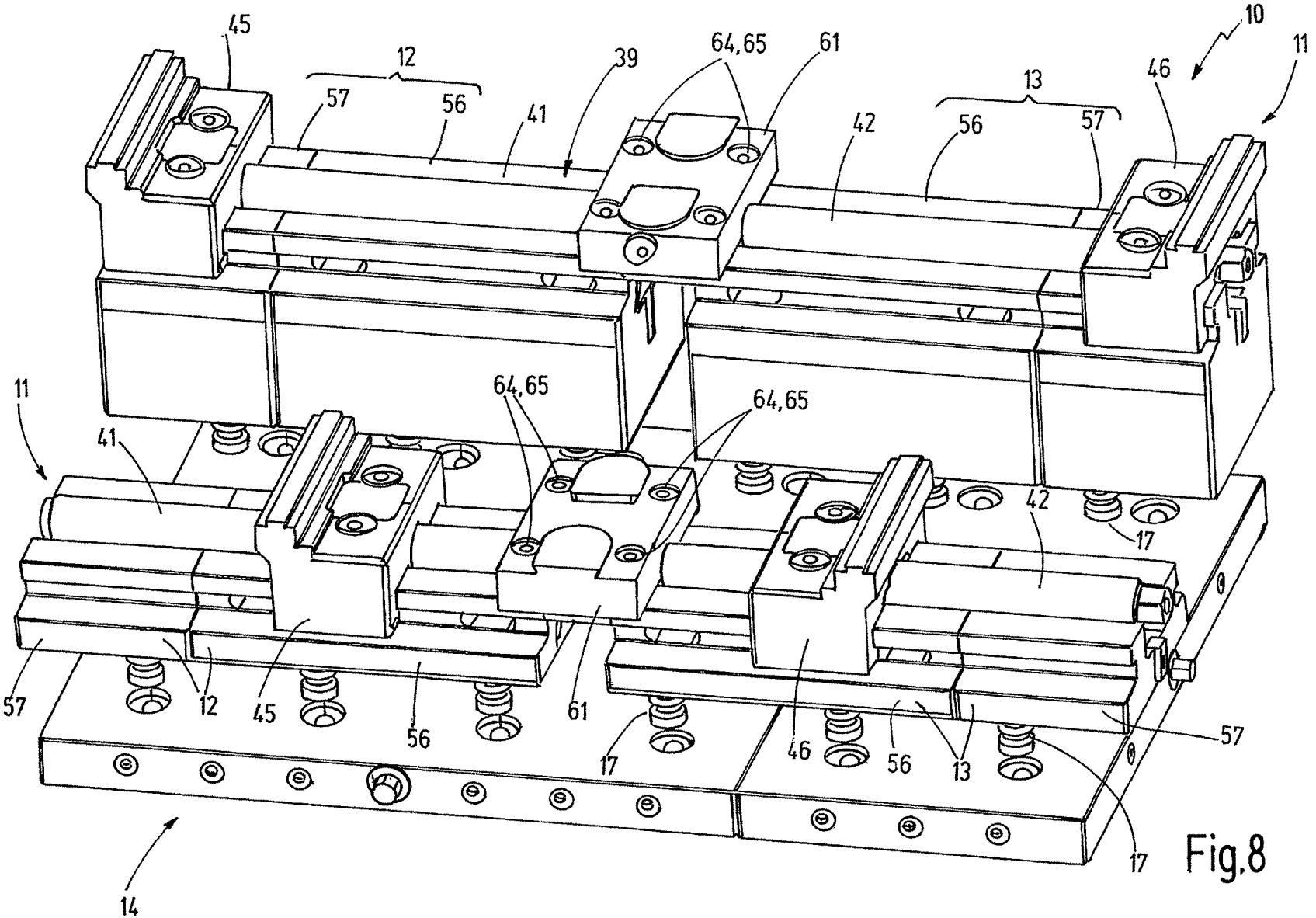

FIG. 8 shows another embodiment of a workpiece clamping device 11. In the illustration the base bodies 12, 13 are not connected with the support 14 and illustrated in a kind of explosion illustration. The configuration of the workpiece clamping device 11 corresponds to one of the embodiments described above with the difference that each base body 12, 13 is not made of one single integral body, but comprises multiple base body parts. In the embodiment illustrated here the base bodies 12, 13 each comprise a first base body part 56 and a second base body part 57. The base body parts 56, 57 have particularly different lengths in longitudinal direction L or in clamping direction R. By combining base body parts 56, 57 having different lengths, different total lengths of the workpiece clamping device 11 can be provided in the manner of a modular system, for example, depending on the dimensions of the workpieces to be clamped. For example, the second base body part 57 can have at most or exactly half of the length in longitudinal direction L as the first base body part 56.

At the connection location between the two base body parts 56, 57 a coupling device 58 is preferably provided in order to couple the two base body parts 56, 57 with each other and in order to align the two base body parts 56, 57 at least in one spatial direction relative to each other, such that an exact guidance for the respective clamping body 45, 46 along the two base body parts 56, 57 is provided. Adjacent to the coupling device 58 the two base body parts 56, 57 abut against each other with surfaces facing each other.

Figure 9:
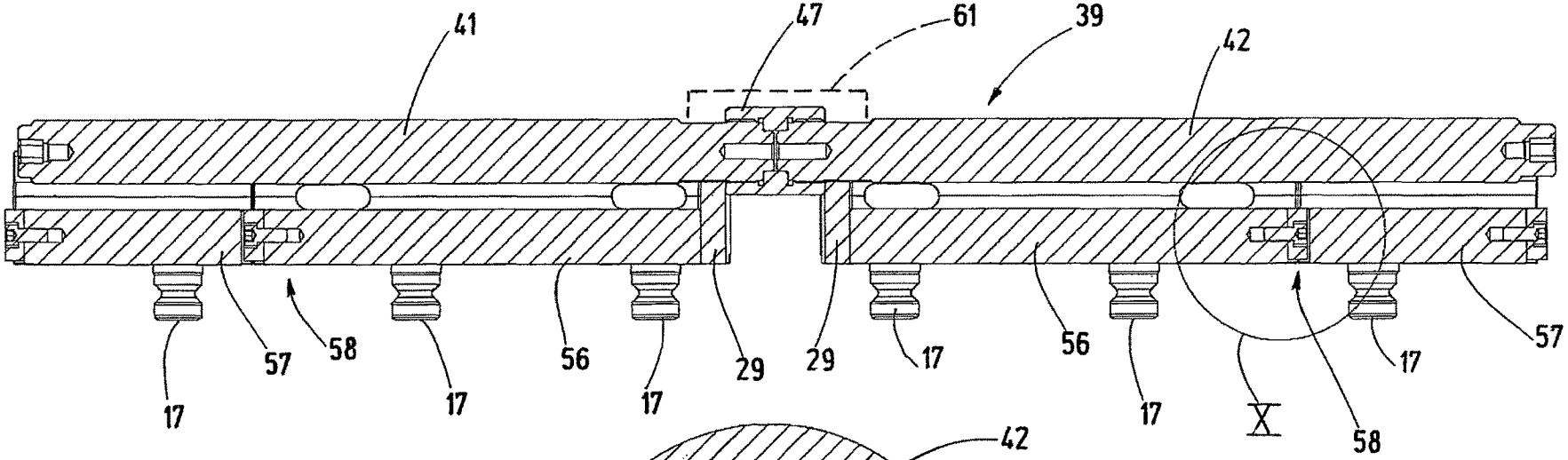

In the embodiment the coupling device 58 can comprise at least one coupling body 59 that projects in longitudinal direction L or in clamping direction R from one of the base body parts 56, 57 and engages an assigned coupling recess 60 on the respective other base body part 57 or 56. By dimensioning the coupling body 59 having the coupling recess 60 to provide precision-fit, the two base body parts 56, 57 can be aligned precisely relative to one another (FIGS. 9 and 10).

Figure 10:
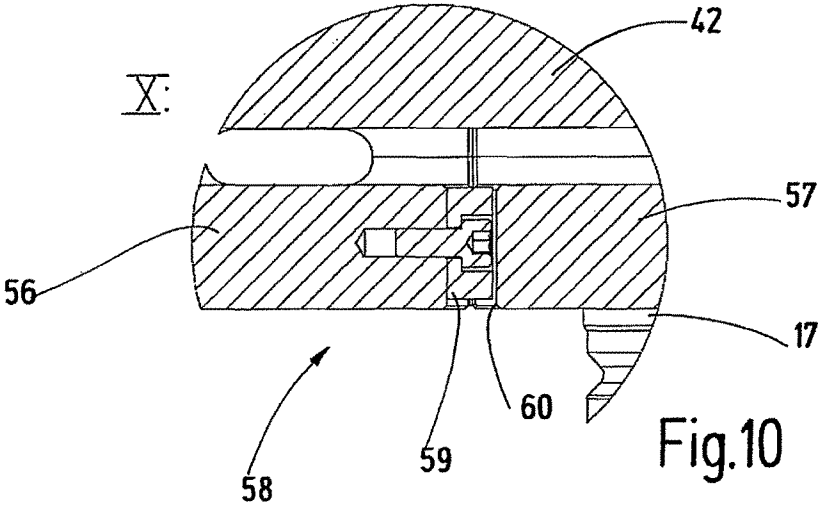

As particularly apparent from FIG. 10, the at least one coupling body 59 is screwed to one of the base body parts according to the example to the first base body part 56, and can be alternatively also attached by other means. The outer dimension of the coupling body 59 in transverse direction Q is dimensioned such that it is equal to the inner dimension of the coupling recess 60 in transverse direction Q apart from the technically necessary clearance. In doing so, a precise positioning of the two base body parts 56, 57 in transverse direction Q relative to each other is achieved. In longitudinal direction L and/or in height direction H orthogonal to the longitudinal direction L and to the transverse direction Q a clearance exists between the at least one coupling body 59 and the assigned coupling recess 60. In doing so, a redundant dimensioning can be avoided.

Due to smaller dimensioning of the second base body part 57, it comprises less attachment pins 17 than the first base body part 56. Particularly, the first base body part 56 has at least four and for example, exactly four attachment pins, whereas the second base body part 57 has less than four and according to the example, two attachment pins 17. In doing so, the exact positioning of the second base body part 57 on the support 14 by means of the attachment device 16 is not always guaranteed and the orientation of the two base body parts 56, 57 is according to the example, defined in addition by the coupling device 58, at least in transverse direction Q.

As particularly apparent from FIG. 8, a connection body 61 can be present in all of the embodiments of the workpiece clamping device 11 explained above, wherein the connection body 61 connects the two base bodies 12, 13 with each other and can thereby bridge an interstice between the two base bodies 12, 13. The connection body 61 is arranged with distance to the support 14 and is not in contact with the support 14 or is not directly attached to the support 14. The connection body 61 can form a cover and can cover the centering body 47 and/or the terminal parts 29.

For this each base body 12, 13 can comprise multiple and according to the example, two connection openings 62, e.g. threaded holes 63, in the area of the end having the mounting surface 35 (FIGS. 1-3). One connection pin 64 can engage in one of the connection openings 62 respectively in order to attach the connection body 61 on the first base body 12 or the second base body 13. In the embodiment each connection pin 64 is formed by a connection screw 65 that engages into the thread of the threaded hole 63 such that the connection body 61 is attached to the first base body 12 as well as the second base body 13 by means of the screw connection.

The connection body 61 particularly serves to connect the two base bodies 12, 13 and does not have any guide function for positioning of the centering body 47. According to the example, the centering body 47 is exclusively positioned by and between the terminal parts 29.

The aspect of composing the base body 12, 13 of multiple base body parts 56, 57 and the coupling thereof by means of a coupling device 58 and/or the aspect of the connection of the two base bodies 12, 13 by means of a separate connection body 61 can also be used independent from other described configurations of the workpiece clamping device 11 and thus form separate independent aspects of the invention.

The invention refers to a workpiece clamping device 11 having a first base body 12 on which a first clamping body 45 is slidably supported in a clamping direction R, as well as a second base body 13 on which a second clamping body 46 is slidably supported in clamping direction R. The two clamping bodies 45, 46 are in engagement with a threaded spindle 39. A contact surface 27 or 28 is provided on each base body 12, 13 on the side that faces the other base body 13 or 12 respectively. The contact surfaces are arranged with base body distance x in clamping direction R. A centering body 47 of the threaded spindle 39 has centering surfaces 48, 49 that abut at one assigned contact surface 27 or 28 respectively in order to position the threaded spindle in clamping direction R without clearance as far as possible.

LIST OF REFERENCE SIGNS

10 Arrangement
11 workpiece clamping device
12 first base body
12*a* face of first base body

13 second base body
13*a* face of second base body
14 Support
15 support surface
16 attachment device
17 attachment pin
18 Hole
19 Slider
20 Channel
21 attachment groove
22 operation element
27 first contact surface
28 second contact surface
29 terminal part
30 first side of terminal part
31 second side of terminal part
32 first attachment surface
33 second attachment surface
34 Step
35 mounting surface
38 Recess
39 threaded spindle
40 limiting surface
41 first thread section
42 second thread section
43 counter-thread of first clamping body
44 counter-thread of second clamping body
45 first clamping body
46 second clamping body
47 centering body
48 first centering surface
49 second centering surface
50 first spindle part
51 second spindle part
52 end section
55 junction location
56 first base body part
57 second base body part
58 coupling device
59 coupling body
60 coupling recess
61 connection body
62 connection opening
63 threaded hole
64 connection pin
65 connection screw
x base body distance
d1 first distance
d2 second distance
H height direction
L longitudinal direction
M center plane Q transverse direction R clamping direction

What is claimed is:

1. A workpiece clamping device, comprising:

a first base body and a second base body, wherein a first contact surface is arranged on a face of the first base body and a first contact surface is arranged of on a face of the second base body, the first contact surface of the first base body facing the first contact surface of the second base body, wherein a base body distance is defined between the first contact surface of the first base body and the first contact surface of the second base body in a clamping direction, a first clamping body that is movably supported on the first base body in the clamping direction, a second clamping body that is movably supported on the second base body in the clamping direction, a threaded spindle extending in the clamping direction and having a first thread section that is in engagement with a counter-thread on the first clamping body and having a second thread section that is in engagement with a counter-thread on the second clamping body, wherein the threaded spindle comprises a centering body that is arranged between the first thread section and the second thread section and abutting against the first contact surface of the first base body and the first contact surface of the second base body.

2. The workpiece clamping device according to claim 1, wherein the first base body and the second base body each comprise a terminal part on which the first contact surface of the first base body and the first contact surface of the second base body is arranged.

3. The workpiece clamping device according to claim 2, wherein the terminal part of the first base body and the terminal part of the second base body comprises a limiting surface that is arranged opposite to the threaded spindle.

4. The workpiece clamping device according to claim 2, wherein the terminal part of the first base body is separate from the first base body and the terminal part of the second base body is separate from the second base body.

5. The workpiece clamping device according to claim 4, wherein the terminal part of the first base body and the terminal part of the second base body comprises a limiting surface that is arranged opposite to the threaded spindle.

6. The workpiece clamping device according to claim 4, wherein the terminal part of the first base body is releasably attached to the first base body and the terminal part of the second base body is releasably attached to the second base body.

7. The workpiece clamping device according to claim 6, wherein the terminal part of the first base body and the terminal part of the second base body each comprise the first contact surfaces of the first and second base body, respectively, on a first side and a second contact surface on a second side opposite the first side.

8. The workpiece clamping device according to claim 7, wherein the terminal part of the first base body and the terminal part of the second base body each comprise a first attachment surface on the first side and a second attachment surface on the second side.

9. The workpiece clamping device according to claim 8, wherein the terminal part of the first base body is attached to the first base body either with the first attachment surface or with the second attachment surface and the terminal part of the second base body is attached to the second base body.

10. The workpiece clamping device according to claim 8, wherein the first contact surface and the second attachment surface each have a first distance from each other in the clamping direction and that the second contact surface and the first attachment surface each have a second distance from each other in clamping direction, wherein the second distance is different from the first distance.

11. The workpiece clamping device according to claim 10, wherein the terminal part of the first base body is attached to the first base body either with the first attachment surface or with the second attachment surface and the terminal part of the second base body is attached to the second base body.

12. The workpiece clamping device according to claim 11, wherein the terminal part of the first base body and the terminal part of the second base body comprises a limiting surface that is arranged opposite to the threaded spindle.

13. The workpiece clamping device according to claim 10, wherein the terminal part of the first base body and the terminal part of the second base body each comprise a step on the second side that separates the second attachment surface from the second contact surface.

14. The workpiece clamping device according to claim 13, wherein the terminal part of the first base body is attached to the first base body either with the first attachment surface or with the second attachment surface and the terminal part of the second base body is attached to the second base body.

15. The workpiece clamping device according to claim 14, wherein the terminal part of the first base body and the terminal part of the second base body comprises a limiting surface that is arranged opposite to the threaded spindle.

16. The workpiece clamping device according to claim 1, wherein the threaded spindle comprises a first spindle part having the first thread section and a second spindle part having the second thread section.

17. The workpiece clamping device according to claim 16, wherein the first spindle part and the second spindle part are connected with each other by the centering body.

18. An arrangement comprising at least two of the workpiece clamping devices according to claim 1, wherein the threaded spindle of each of the at least two workpiece clamping devices extend parallel to one another in a longitudinal direction and wherein the centering bodies body of each of the at least two workpiece clamping devices are centrally arranged with regard to a common center plane that is orientated orthogonal to the longitudinal direction.

19. An arrangement comprising at least two of the workpiece clamping devices according to claim 1, wherein the threaded spindle of a first of the at least two workpiece clamping devices extends in a longitudinal direction and the threaded spindle of a second of the at least two workpiece clamping devices extends in a transverse direction orientated orthogonal to the longitudinal direction such that the threaded spindles of the first and second of the at least two workpiece clamping devices cross each other.

20. The arrangement according to claim 19, wherein the centering body of the threaded spindle of the first of the at least two workpiece clamping devices is arranged symmetrically to a center plane that extends along a threaded spindle longitudinal axis of the threaded spindle of the second of the at least two workpiece clamping devices.

* * * * *